US005249539A

United States Patent [19]

Hyca

[11] Patent Number: 5,249,539

[45] Date of Patent: Oct. 5, 1993

[54] TAPE FEED-IN DEVICE ON A PRESSER FOOT ASSEMBLED ON A SEWING MACHINE

[75] Inventor: Bohumil Hyca, Stuttgart, Fed. Rep. of Germany

[73] Assignee: Union Special GmbH, Stuttgart, Fed. Rep. of Germany

[21] Appl. No.: 886,747

[22] Filed: May 21, 1992

[30] Foreign Application Priority Data

May 28, 1991 [DE] Fed. Rep. of Germany ..... 4117359

[51] Int. Cl.[5] ..... D05B 35/10; D05B 29/06

[52] U.S. Cl. ..... 112/121.27; 112/152; 112/153; 112/235

[58] Field of Search ..... 112/152, 121.27, 121.26, 112/153, 305, 235; 400/645, 642; 226/196, 198, 199; 242/75.2, 76; 271/240

[56] References Cited

U.S. PATENT DOCUMENTS

| | | | |
|---|---|---|---|
| 570,036 | 10/1896 | Merrick | 112/152 |
| 570,037 | 10/1896 | Merrick | 112/152 |
| 973,385 | 10/1910 | Resch | 400/645 X |
| 1,827,596 | 10/1931 | Maier | 112/152 |
| 3,198,151 | 8/1965 | Micale | 112/152 |
| 4,143,604 | 3/1979 | O'Keefe | 112/152 |
| 4,903,622 | 2/1990 | Frey et al. | 112/152 |
| 4,913,071 | 4/1990 | Kawasaki | 112/152 |
| 4,920,439 | 4/1990 | Bordignon | 226/196 X |

FOREIGN PATENT DOCUMENTS

| | | |
|---|---|---|
| 474322 | 4/1929 | Fed. Rep. of Germany . |
| 8811711 | 12/1988 | Fed. Rep. of Germany . |
| 3823946C2 | 6/1990 | Fed. Rep. of Germany . |

*Primary Examiner*—Clifford D. Crowder
*Assistant Examiner*—Paul C. Lewis
*Attorney, Agent, or Firm*—Willian Brinks Olds Hofer Gilson & Lione

[57] ABSTRACT

A sewing machine has a tape feeder for laterally aligning pre-positioned tapes of different widths at a presser foot (38) with a presser foot sole (4), the presser foot arranged in such a way that it can move up and down. Several guide elements (15) constructed in the form of lamallae (34) and aligned in the tape feed direction are fitted in the tape in-feed region on the presser foot sole (4). These guide elements (15) guide the tapes laterally.

11 Claims, 2 Drawing Sheets

TAPE FEED-IN DEVICE ON A PRESSER FOOT ASSEMBLED ON A SEWING MACHINE

BACKGROUND OF THE INVENTION

The invention relates to a tape-feeder at a presser foot arranged in a sewing machine.

When stitching pre-positioned tapes, which are different widths and which can be pliable or elastic, on to a workpiece, it is necessary to align or rather guide the tapes laterally towards the sewing machine needle, in order to ensure that, in each case, the tape to be stitched on is positioned exactly on the workpiece.

This is possible with a device according to German Patent No. 474322, by means of a fork which can be locked in position and which is longitudinally movable transversely to the tape feed direction, the fork being supported by a wall fitted to the presser foot. However, where the widths of the tapes to be stitched on to the workpiece are different, it is necessary, in each case, to newly position a fork corresponding to the width of the tape. This leads to an undesired interruption of the actual work flow.

An object of the invention is therefore to further develop a tape feeder in such a way that the tape feeder can be quickly and simply adjusted to suit tapes of different widths.

SUMMARY OF THE INVENTION

The present invention resides in a tape feeder for laterally aligning pre-positioned tapes of different widths on a presser foot having a presser foot sole and arranged in a sewing machine in such a way that it can move up and down, in which several resilient guide elements are fitted in the take-in-feed region of the presser foot sole and are constructed like lamellae aligned in the tape feed direction.

The resilient guide elements, constructed like lamellae and aligned in the tape feed direction in advance of the presser foot sole, i.e. in the tape in-feed region of the presser foot automatically adjust themselves to the different tape widths, because their lateral rigidity enables them to form guide channels of different widths according to the width of the tape; the guide channels receive the tape and carry out the lateral alignment.

The attachment of the guide elements constructed as rods in a holder arranged transversely to the tape feed direction facilitates a simple construction of the tape feeder.

It is advantageous to arrange the holder movably mounted on a wall arranged on the presser foot sole in such a way that it is laterally displaceable and can be locked in position. In this way it is possible to preset the side wall of the tape guide channel by means of the wall and the position of the tape guide channel can be varied.

By means of a stop screw the resilient element can ensure advantageously and simply that the guide elements remain in their preset tape guiding position while the tape is being stitched to the workpiece and thus the respective tapes are laterally aligned and guided.

In a design which enables the tapes to be changed easily, the free ends of the guide elements can be pivoted away from the presser foot sole against the effect of the resilient elements by means of a stop on the sewing machine and thus considerably enlarges the outlet opening on the tape feeder at the point of transfer from the presser foot sole to the needle plate.

BRIEF DESCRIPTION OF THE DRAWINGS

The present invention will now be described further, by way of example, with reference to the accompanying drawings, in which.

DETAILED DESCRIPTION OF THE PREFERRED EMBODIMENTS

Figure 1:
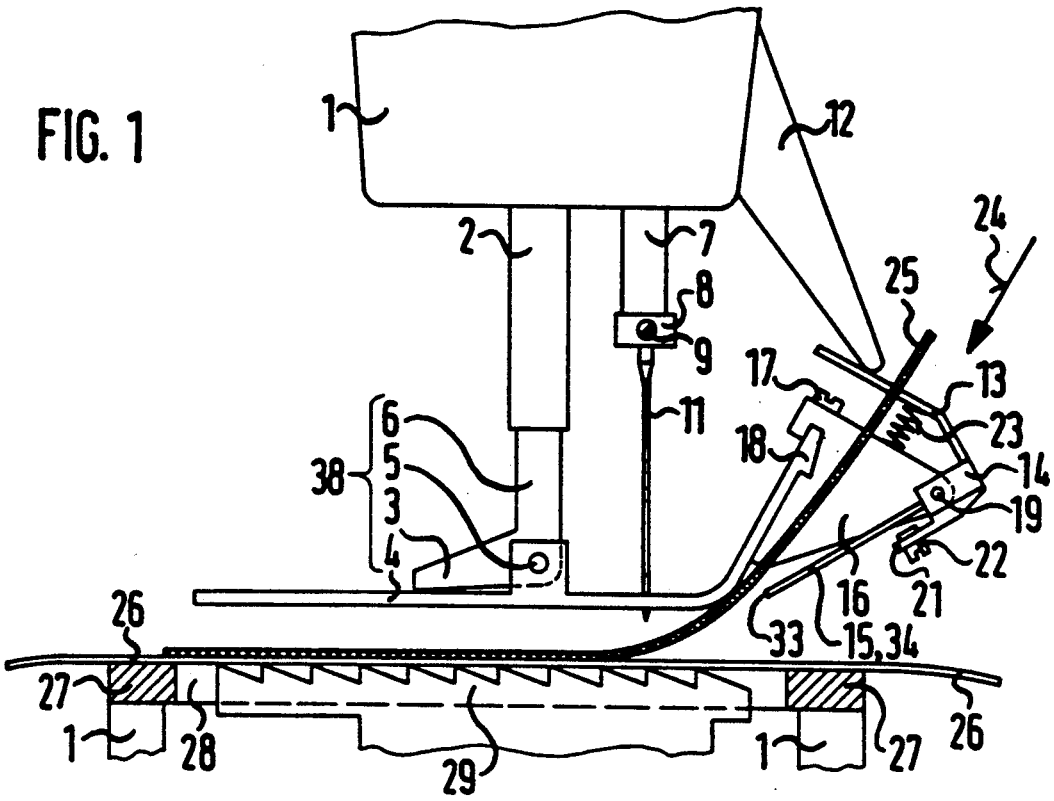
FIG. 1 is a side view of a tape feeder with raised presser foot and guide elements pivoted away from the presser foot sole.

FIG. 1 shows a part of a sewing machine with a tape feeder. Projecting out of a housing 1 of the sewing machine there is a presser rod 2 arranged to move up and down and having a stop piece 3, which positions a presser foot sole 4. A pin 5 connects the presser foot sole 4 pivotably to a block 6 which is attached to the presser rod 2.

A needle bar 7 arranged to move up and down projects out of the housing 1 and supports a ring 8, which has a sewing machine needle 11 attached in it by a screw 9. A stop 12 fitted to the housing 1 operates an angled piece 13 which is part of a holder 14, in which the guide elements 15 are attached.

A wall 16 which is laterally adjustably attached by a screw 17 to a tape in-feed region 18 of the presser foot sole 4, supports a pin 19, around which holder 14 is pivotably journalled. A stop screw 22 for adjusting the guide elements 15 into a prescribed position to the presser foot sole 4 is arranged on a lug 2 of the holder 14. A resilient element 23 is arranged between the wall 16 and angled piece 13 and-works against the latter.

An arrow 24 indicates the feed direction of a pre-positioned tape 25 which is laterally aligned and applied to a workpiece 26.

The workpiece 26 lies on a needle plate 27, through which a feed dog 29 grips through a slot 28 which engages the workpiece 26 and operates the feed for the workpiece and the tape.

Figure 2:
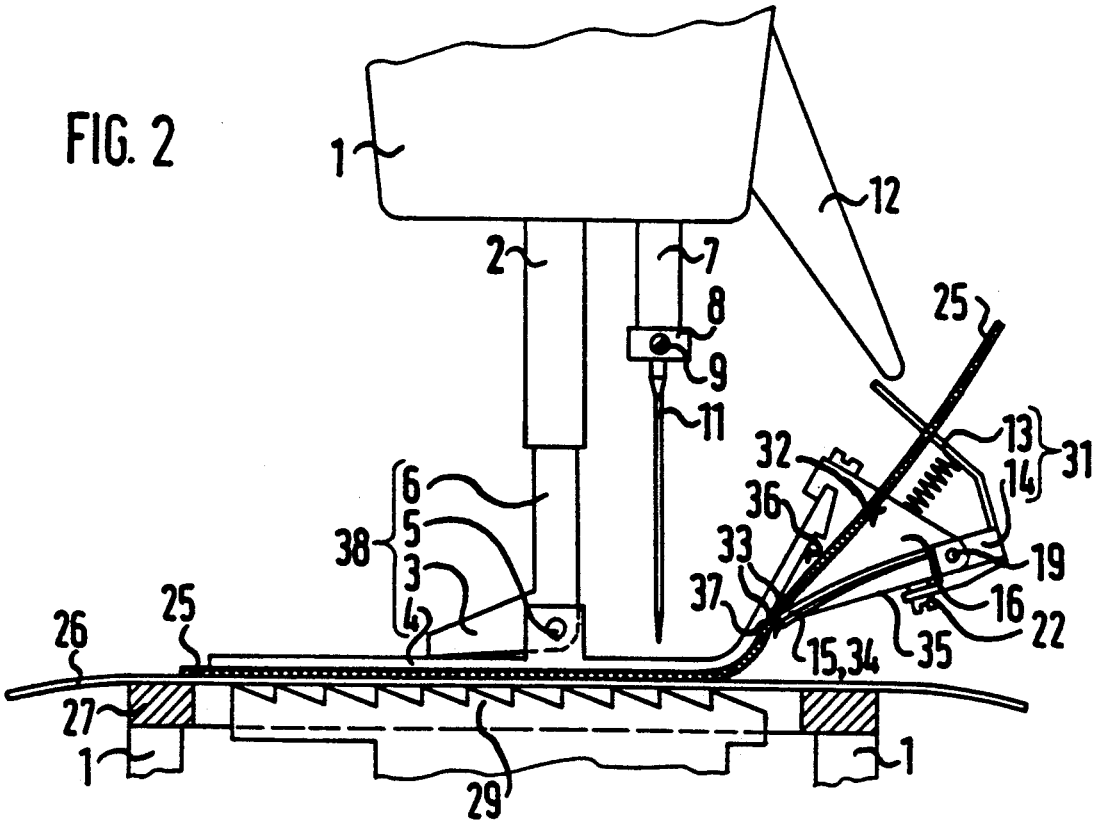
FIG. 2 is a side view of the tape feeder with lowered presser foot and free ends of the guide elements arranged against the presser foot sole.

FIG. 2 shows the angled piece 13 and the holder 14 of the tape feeder with the presser rod 2 lowered in a tape-guiding position 31 which is adjustably defined by means of the stop screw 22 working against the front side 35 of the wall 16. The angled piece 13 is not engaged here in the stop 12. Owing to the thickness of the tape 25, the free ends 33 of the guide elements 15 constructed in the form of rods are arranged in advance of the tape 25 and arranged in the preset position against the lower face 32 of the tape 25; the free ends 33 of the guide elements 15 constructed in the form of rods 34 are laterally arranged next to tape 25 and are arranged in the preset position against the lower side 36 of the presser foot sole 4. This produces a stepping 37 of the free ends of the guide elements 15 and rods 34.

Figure 3:
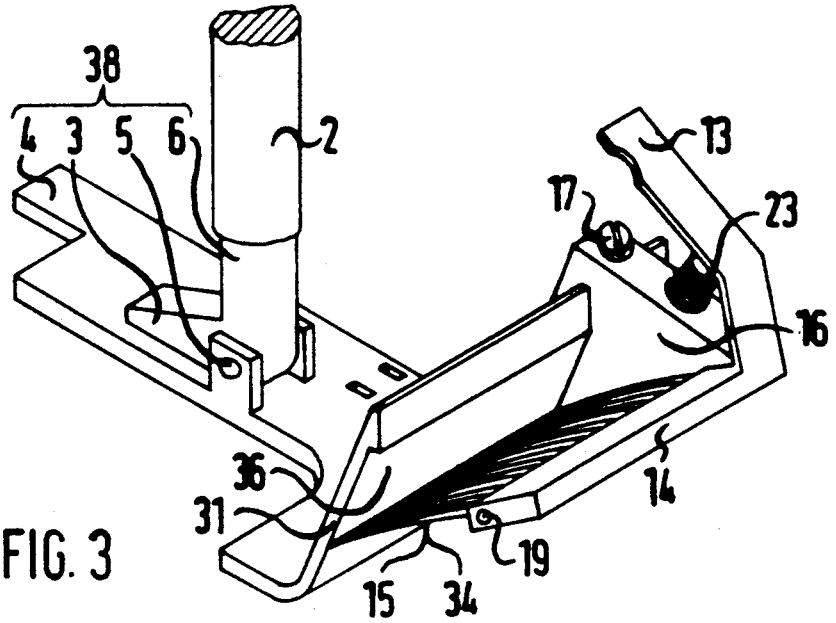
FIG. 3 is a perspective sectional view of the tape feeder.

FIG. 3 shows a presser foot 38, in thetape guide position 31, the presser foot comprising a stop piece 3, sole 4, pin 5 and block 6, and elucidates the construction, arrangement and function of the guide elements 15, constructed in the form of lamallae, illustrated without tape 25, or rods 34, which are attached in the holder 14 arranged transversely to the tape feed direction.

Figure 4:
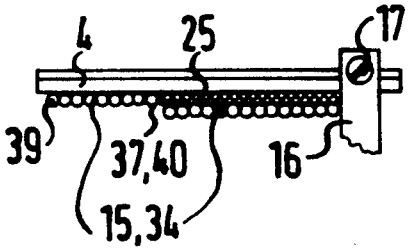
FIG. 4 is a plan view of a guide channel, formed by the guide elements, with tape.

As shown in FIG. 4, the guide elements 15 or rods 34 are constructed in an approximately circular cross section 39. Owing to the width of the tape 25, a step 37 of the guide elements 15 and rods 34 is produced, which enables the tape to be guided laterally 40. Additional lateral guidance of the tape 25 is provided by the wall 16.

Figure 5:
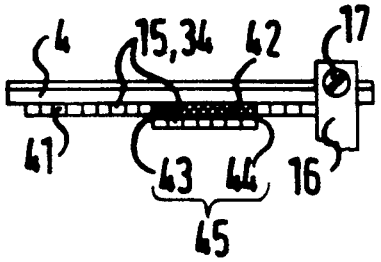
FIG. 5 is a further plan view of a guide channel formed by the guide elements, with tape.

FIG. 5 shows a further type of design of the guide elements 15 or rods 34 and in fact have a rectangular cross section 41. Owing to the smaller width of an additional tape 42, a guide edge 43 is produced, which is laterally displaced in comparison to the step 37 according to FIG. 4, and a further guide edge 44.

The guide edges 43 and 44 form the lateral limitation of a guide channel 45 for tape 42. As shown in FIG. 4, tape 25 is laterally guided by the wall 16 and step 37.

Owing to the rectangular cross section 41 a considerably increased lateral rigidity of the guide element 15 is produced in comparison to the circular cross section 39, this rigidity advantageously improves the lateral stabilisation of the guide channel 45.

I claim:

1. A tape feeder in combination with a presser foot, the presser foot having a presser foot sole, for laterally aligning prepositioned tapes of different widths, in which several resilient guide elements are positioned by a support connected between the presser foot sole and one end of the guide elements in a tape in-feed region of the presser foot sole, the guide elements being arranged adjacent to each other and aligned in a tape feed direction, whereby the guide elements receive and laterally align the prepositioned tapes of different widths.

2. A tape feeder as claimed in claim 1, in which the guide elements are attached in a holder arranged transversely to the tape feed direction, the holder being connected to the presser foot sole by a wall.

3. A tape feeder as claimed in claim 1, in which the guide elements are rods, whose free ends are arranged in a pre-set position against the presser foot sole and the tape.

4. A tape feeder as claimed in claim 2, in which the wall is slidably mounted on the presser foot sole in such a way that it is laterally displaceable and can be locked in position.

5. A tape feeder as claimed in claim 4, in which the holder is pivotally mounted on the wall.

6. A tape feeder as claimed in claim 5, in which a resilient member is connected between the wall and the pivotally mounted holder for pushing the guide elements into a pre-set position against the presser foot sole and the prepositioned tape.

7. A tape feeder as claimed in claim 6, in which a stop is located above the pivotally mounted holder, the stop being operable to pivot the holder against the effect of the resilient member when the presser foot is raised, such that the guide elements are moved away from the presser foot sole.

8. A tape feed-in device on a presser foot assembled on a sewing machine comprising:

a presser foot sole;

a wall mounted on the presser foot sole;

a holder pivotally mounted on the wall and arranged transversely to a tape feed direction; and a plurality of resilient guide elements aligned in the tape feed direction, each resilient guide element having a proximal end that is secured by the holder and a distal free end positioned in a tape in-feed region of the presser foot sole, whereby the resilient guide elements receive and laterally align prepositioned tapes of different widths.

9. A tape feed-in device as claimed in claim 8 further comprising a resilient member connected between the wall and the holder that is operable to pivot the holder such that the free end of the resilient guide elements move to a pre-set position against the presser foot sole and a prepositioned tape.

10. A tape feed-in device as claimed in claim 9, further comprising a stop located above the pivotally mounted holder, the stop being operable to pivot the holder against the effect of the resilient member when the presser foot is raised, such that the resilient guide elements are moved away from the pre-set position against the presser foot sole.

11. A tape feed-in device as claimed in claim 8, wherein the resilient guide elements have a rectangular cross section.

* * * * *

UNITED STATES PATENT AND TRADEMARK OFFICE

CERTIFICATE OF CORRECTION

PATENT NO. : 5,249,539
DATED : October 5, 1993
INVENTOR(S) : Bohumil Hyca

It is certified that error appears in the above-indentified patent and that said Letters Patent is hereby corrected as shown below:

In column 1, line 7, delete "tape-feeder" and substitute --tape feeder-- therefor.

In column 2, line 39, delete "2" and substitute --21-- therefor.

In column 2, line 41, delete "and-works" and substitute --and works-- therefor.

In column 2, line 64, delete "thetape" and substitute --the tape-- therefor.

Signed and Sealed this

Sixth Day of September, 1994

Bruce Lehman

*Attest:*

BRUCE LEHMAN

*Attesting Officer*

*Commissioner of Patents and Trademarks*